United States Patent [19]

Noda et al.

[11] Patent Number: 4,832,611

[45] Date of Patent: May 23, 1989

[54] ELECTRICAL CONNECTOR COMPRISING COMBINATION OF INDIVIDUAL MATING AND PIN ELEMENTS AS A CONTACT MEMBER

[75] Inventors: Atsuhito Noda; Yoshiaki Ichimura; Mitsuo Komoto; Shoji Umesato, all of Tokyo, Japan

[73] Assignees: Japan Aviation Electronics Industry, Limited; NEC Corporation, both of Japan

[21] Appl. No.: 108,784

[22] Filed: Oct. 15, 1987

[30] Foreign Application Priority Data

Oct. 18, 1986 [JP] Japan ..... 61-246496

[51] Int. Cl.[4] ..... H01R 23/72

[52] U.S. Cl. ..... 439/70; 439/342

[58] Field of Search ..... 439/58, 68–73, 439/525, 342

[56] References Cited

U.S. PATENT DOCUMENTS 3,918,784 11/1975 Lemke et al. ..... 439/70

4,099,816 7/1978 Bittner et al. ..... 439/525

4,631,377 12/1986 Imazeki et al. ..... 439/619

*Primary Examiner*—Neil Abrams

*Attorney, Agent, or Firm*—Laff, Whitesel, Conte & Saret

[57] ABSTRACT

For electrically connecting a conductive terminal member (13) to an electric circuit board (12), an electrical connector includes a contact member (30) which comprises a terminal pin element (31) and a mating contact element (32) as individual parts. The terminal pin element is inserted into a through hole (14) and secured to the electric circuit board by soldering. The mating contact element is mated with the terminal pin element within an insulator housing (16) so that it is possible to correct position error of a contact portion (42) of the mating contact element. The conductive terminal member is inserted into the insulator housing and is then moved by a driving member (17) which is slidable along the insulator housing. Therefore, the conductive terminal member is brought into contact with a contract portion of the mating contact element. As a result, electrical connection is reliably made between the terminal member and an electrical circuit on the electric circuit board.

9 Claims, 4 Drawing Sheets

ELECTRICAL CONNECTOR COMPRISING COMBINATION OF INDIVIDUAL MATING AND PIN ELEMENTS AS A CONTACT MEMBER

BACKGROUND OF THE INVENTION:

This invention relates to an electrical connector for use in electrically connecting a conductive terminal member to an electrical circuit which is formed on an electric circuit board.

Various electrical connectors of the type are already known. For example, an electrical connector is disclosed in JP-A-60-162,391 (Kokai or Publication of Unexamined Patent Application) by the same applicants of the present application. The electrical connector comprises an insulator housing and a contact member contained in the insulator housing. The contact member is formed from a thin conductive plate by press working and comprises a contact portion and a pin portion which are integral with one another. The contact portion is for making a contact with a conductive terminal member, such as of a pin form. The pin portion is for making a contact with an electrical circuit on an electric circuit board.

Generally, the electric circuit board is provided with a through hole for receiving the pin portion of the contact member. The through hole has a conductive member coated on an inner surface of the through hole. The conductive member is electrically connected to the electrical circuit.

The pin portion is slender and press fitted into the through hole to come into contact with conductive member. As a result, the contact member is supported by the electric circuit board and electrically connected to the electrical circuit through the conductive member.

When the pin portion is press fitted into the through hole, frictional force occurs between the pin portion and the inner peripheral surface of the through hole. In this event, the pin portion is often bent by buckling due to the frictional force. The bent terminal does not insure a desired contact between the conductive terminal member and the contact portion.

In order to prevent the pin portion from such buckling, the pin portion is often made to have a reduced size in comparison with a diameter of the through hole. In this case, soldering is applied to fixedly connect the pin portion to the electrical circuit after the pin portion is loosely inserted in the through hole. In this event, the contact element is apt to incline in relation to a predetermined axis which is perpendicular to the electric circuit board. This is because a space is left between the pin portion and the inner peripheral surface of the through hole.

When the contact element is inclined, the contact portion is displaced from a predetermined position where a desired contact is obtained between the conductive terminal member and the contact portion. Accordingly, the desired contact cannot be portion.

In addition, the contact portion may be subjected to trouble in repetition of connection and disconnection with the conductive terminal member. However, since the contact member is fixedly secured to the electric circuit board by the soldering, the contact portion cannot be repaired after trouble occurs on the contact portion.

SUMMARY OF THE INVENTION

It is therefore an object of the present invention to provide an electrical connector in which a contact portion of a contact member does not suffer from a position error when mounting the contact member to an electric circuit board by soldering.

It is another object of the present invention to provide an electrical connector in which it is readily capable to repair the contact portion in spite of soldering the contact member to the electric circuit board.

An electrical connector to be assembled on an electric circuit board is used for electrical connection of a plurality of conductive terminal members to an electrical conductive pattern formed on the electric circuit board with a through hole formed therein. The electrical connector comprises an insulator housing to be mounted on the electric circuit board and a contact member to be fixedly and electrically connected to the electrical conductive pattern and to be mated with the conductive terminal member, the insulator housing having a containing hole for receiving the conductive terminal member and for containing the contact member in the assembled condition. According to the present invention, the contact member comprises a terminal pin element and a mating contact element which are different individual parts. The terminal pin element comprises a top connecting portion and a pin portion to be inserted in the through hole of the electric circuit board and soldered with the electrical conductive pattern of the electric circuit board. The mating contact element comprises a top contact portion for mating with the conductive terminal member and a lower mating portion for mating with the top connecting portion of the terminal pin element. The top connecting portion of the terminal pin element and the mating contact element are disposed on the containing hole in the assembled condition.

Figure 1:
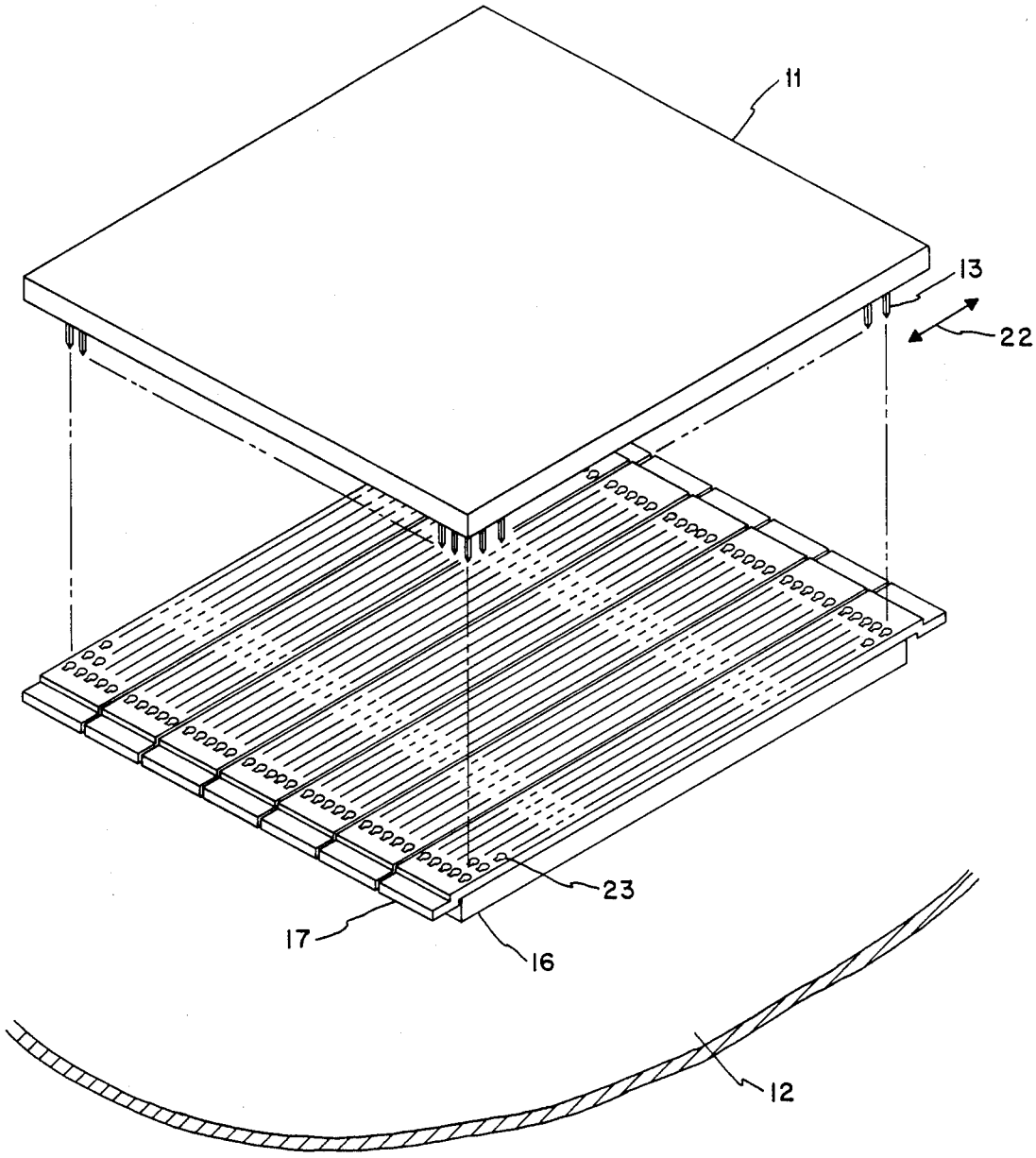
FIG. 1 PRIOR ART
FIG. 1 is a perspective view showing a conventional electrical connector, together with a large scale integrated circuit package and an electric circuit board.
Figure 2:
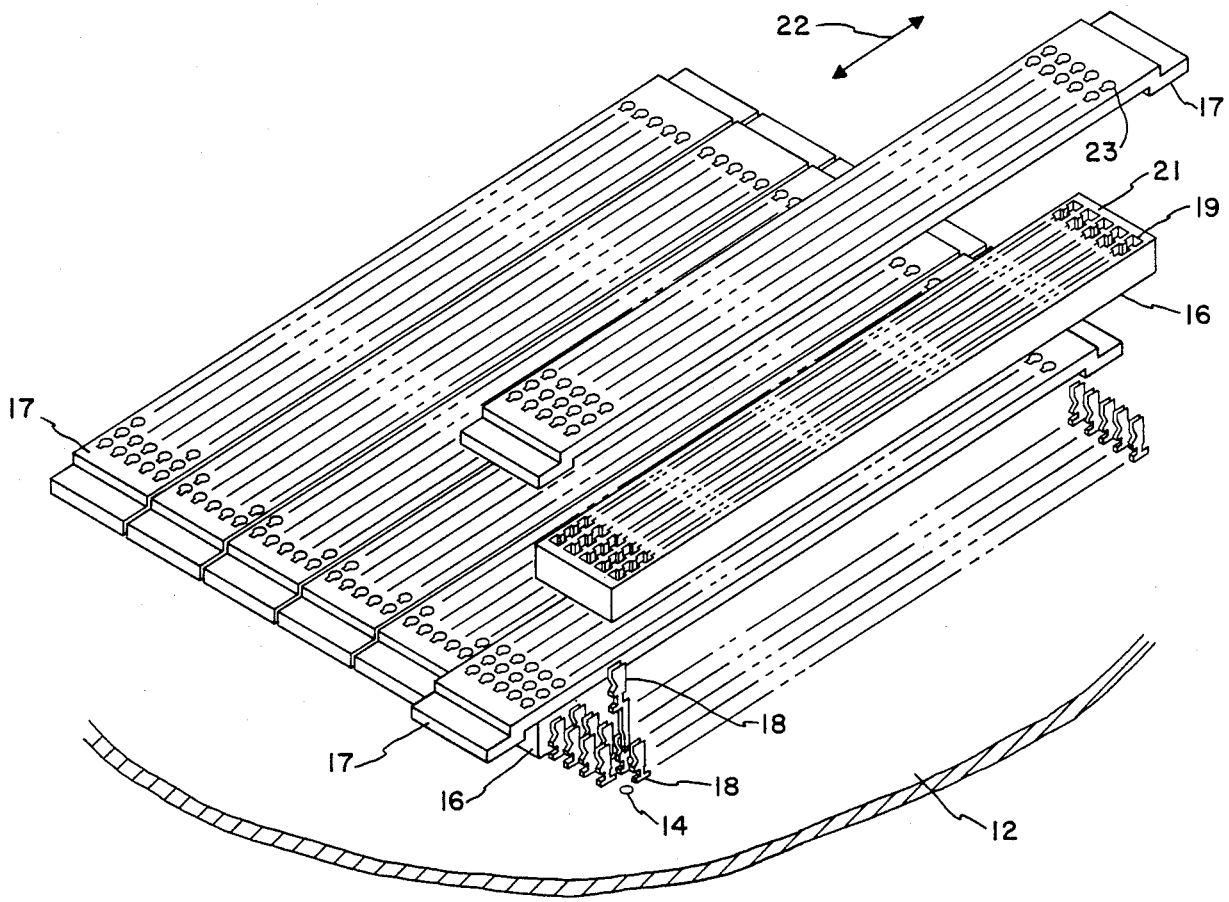
FIG. 2 PRIOR ART
FIG. 2 is a partially exploded view showing the electrical connector together with the electric circuit board shown in FIG. 1.

DESCRIPTION OF PREFERRED EMBODIMENTS:

Referring to FIGS. 1 and 2, a conventional electrical connector will be described at first for better understanding of the present invention. The conventional electrical connector is for use in mounting a large scale integrated circuit package 11 on an electric circuit board 12. The large scale integrated circuit package 11 has a plurality of conductive terminal members 13 projecting from one of main surfaces of thereof. The conductive terminal members 13 are arranged in a predetermined matrix form but only several ones are shown in the figure for the simplification of the drawing while the remaining ones being indicated by imaginary lines. The electric circuit board 12 has a plurality of through holes 14 formed thereto. The through holes 14 are arranged corresponding to the predetermined matrix form but only several ones are also shown for the purpose of simplification. The electric circuit board 12 includes an electric conductive pattern (not shown) in the manner known in the art. Each of the through holes 14 has a conductive member (not shown) coated on the inner surface of the hole. The conductive member is electrically connected to the electrical circuit in the manner known in the art.

The electrical connector comprises a plurality of insulator housings 16, a plurality of driving plates 17, and a plurality of contact members 18. Each of the insulator housings 16 is made of an insulating material in a form of a generally rectangular parallelopiped. The insulator housings 16 are disposed on the electric circuit board 12 to be adjacent to one another. Each of the insulator housings 16 is provided with a plurality of contact containing holes 19 for containing the contact members 18, respectively. The contact containing holes 19 are arranged in dependence on the predetermined matrix form. The contact containing holes 19 extends in the insulator housings 16 from a top surface 21 to a bottom surface which is opposite to the circuit board 12.

The driving plates 17 are mounted on the top surfaces 21 of the insulator housings 16 and are slidable along the top surfaces 21 in a predetermined horizontal direction 22, respectively. Each of the driving plates 17 is also provided witha plurality of terminal receiving holes 23 for receiving the conductive terminal members 13, respectively. The terminal receiving holes 23 are also arranged in dependence on the predetermined matrix form but only several ones are shown in the figures for the purpose of simplification of the drawing while the remaining ones being indicated by imaginary lines. Namely, the terminal receiving holes 23 are corresponding to the contact containing holes 19, respectively.

Figure 3:
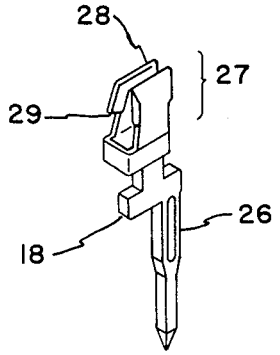
FIG. 3 PRIOR ART
FIG. 3 is an enlarged perspective view of a contact element which is used in the electrical connector shown in FIGS. 1 and 2.

The contact members 18 are of conductive material and inserted into the contact containing holes 19, respectively. Several containing holes are shown in the figures for the purpose of simplification of the drawing. Each of the contact elements 18 comprises a pin portion 26 and a contact portion 27, as shown in FIG. 3. The pin portion 26 is press fitted into each of the through hols 14 of the electric circut board 12. As a result, the pin portion 26 makes a contact with the conductive member of the through hole 14 of the electric circuit bard 12. The contact portion 27 projects upwardly from an upper surface of the electric circuit board 12 and is contained in the contact containing hole 19. Namely, the contact members 18 are substantially mounted in the insulator housing 16. The contact portion 27 is provided with a pair of contact plates 28 and a pair of guide portions 29 which are integral with one another.

The large scale integrated circuit package 11 is placed on the driving plates 17 with the conductive terminal members 13 inserted into the terminal receiving holes 23, respectively. In this event, the conductive terminal members 13 are inserted into the containing holes 19 of the insulator housings 16, too, so that the conductive terminal members 13 are located adjacent the contact members 18 in the predetermined horizontal direction 22.

When the driving plates 17 are moved along the top surfaces 21 of the insulator housings 16 in the predetermined horizontal direction 22, the large scale integrated circuit package 11 is carried so that ech of the conductive terminal members 13 are slidably inserted between the contact plates 28. As a result, the conductive terminal members 13 come into contact with the contact members 18.

Thus, the conventional electrical connector serves to mechanically and electrically connect the large scale integrated circuit package 11 to the electric circuit board 12.

However, the conventional electrical connector is disadvantageous in that the pin portion 26 may be bent by buckling when it is press fitted into the through hole 14, as described hereinbefore. This results in obstruction of high density assembly of the contact members 13 in the electrical connector.

As has been described in preamble of the description, the pin portion 26 can be made with a reduced diameter in comparison with the diameter of the through hole 14 so as to free the pin portion 26 from buckling. However, the modification also has disadvantages as described in the preamble.

Figure 4:
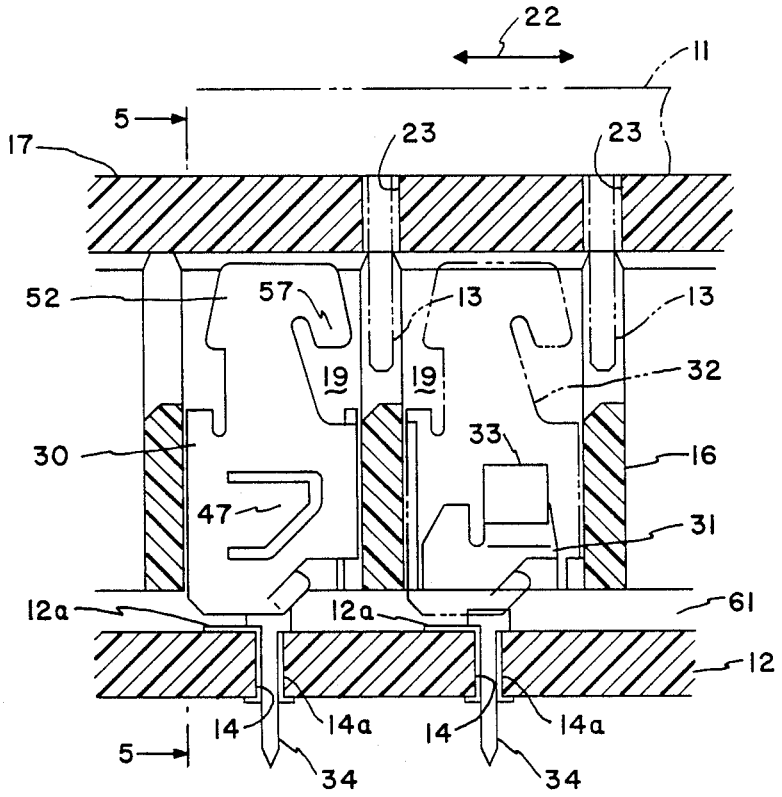
FIG. 4 is an enlarged sectional view showing an electrical connector according to an embodiment of this invention together with the electric circuit board.
Figure 5:
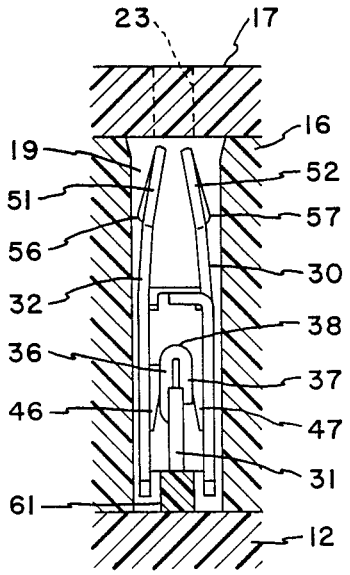
FIG. 5 is a sectional view taken along a line 5—5 in FIG. 4
Figure 6:
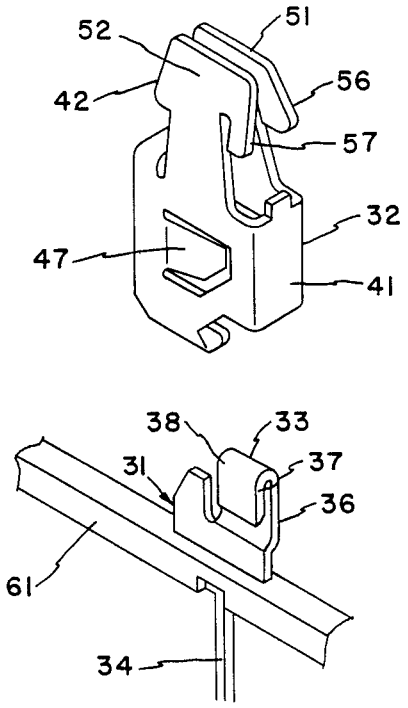
FIG. 6 is an exploded perspective view of a contact member and a contact holder used in the electrical connector shown in FIGS. 4 and 5.

Referring to FIGS. 4 to 6, description will be made in relation to an electrical connector according to an embodiment of the present invention. The electrical connector comprises similar parts designated by the same reference numerals.

In the manner which will be described in the following, the electrical connector comprises a plurality of contact members 30. Each of the contact members 30 comprises a terminal pin element 31 and a mating contact element 32 which are made of conductive materials such as conductive plates into individual parts.

The terminal pin element 31 comprises top connecting and pin portions 33 and 34 which are integral with one another. The top connecting portion 33 is placed in a predetermined one of the contact containing holes 19 of the insulator housing 16 and comprises first plate, second plate, and curved portions 36, 37, and 38. The first plate portion 36 is integrally connnected to the pin portion 34. The second plate portion 37 is opposite to the first plate portion 36 with a predetermined space left therebetween. The curved portion 38 is integrally connected between the first and the second plate portions 36 and 37 or maintaining the predetermined space.

The pin portion of 34 is electrically connected to the electrical conductive pattern **14*a* in the through hole 14 by soldering in the manner known in the art. The conductive member 14*a* is connected to the electrical conductive pattern 12*a* formed on the electric circuit board 12. The pin portion 34 extends from the top connecting portion 33 to project from the bottom surface of the insulator housing 16 disposed in the electric circuit board 12. The pin portion 34 further extends and is loosely fitted into the through hole 14 of the electric circuit board 12. Namely, a circular space is left between the pin portion 34 and the inner surface of the through hole 14. In this event, the pin portion 34 is not bent during insertion into the through hole 14 because frictional force does not occur between the pin portion 34 and the inner surface of the through hole 14**.

After the pin portion is inserted into the through hole 14, soldering is applied to electrically and mechanically connect the pin portion 34 and the conductive member 14a which is coated on the inner surface of the through hole 14. As a result, the terminal path element 31 is electrically connected to the electrical conductive pattern 12*a* on the electric circuit board 13 through the conductive member 14*a* thereon.

The mating contact element 32 comprises a lower mating portion 41 and a top contact portion 42 which are integral with one another. The mating contact element 32 is placed in the predetermined one of the contact containing holes 19 of the insulator housing 16 disposed on the electric circuit board 12. The lower mating portion 41 is mated with the top connecting portion 33 of the terminal pin element 31 as will become clear in the following.

The lower mating portion 41 is provided with first and second leaf spring portions 46 and 47 which are opposite to one another. The first and second leaf spring portions 46 and 47 slidably engage the top connecting portion 33 of the terminal pin portion 31 therebetween so that the first leaf spring portion 46 is brought into contact with the first plate portion 36 while the second leaf spring portion 47 coming into contact with the second plate portion 37.

The top contact portion 42 is eletrically connected to the conductive terminal member 13. The top contact portion 42 extends from the lower mating portion 41 and comprises first and second contact plates 51 and 52 opposite to one another. The first and second contact plates 51 and 52 are positioned in the containing hole 19 and adjacent each top surface 21 of the insulator housings 16. The first and second contact plates 51 and 52 slidably receives the conductive terminal member 13 therebetween.

In order to smoothly receive the conductive terminal member 13 between the first and second contact plates 51 and 52, the mating contact element 32 further comprises first and second guide plates 56 and 57 which extend from the first and second contact plates 51 and 52, respectively.

The electrical connector further comprises a plurality of contact holders 61 which serves as will latter be clear. The contact holders 61 are laid between the electric circuit board 12 and the insulator housing 16 and extend in parallel with one another. Each of the contact holders 61 is positioned under a row of predetermined ones of the contact containing holes 19 and holds the pin portions 34 of a predetermined ones of terminal pin elements 31 which are corresponding to the predetermined ones of the contact containing holes 19, respectively.

The conductive terminal members 13 are inserted in the contact containing holes 19 of the insulator housings 16 through the terminal receiving holes 23 to be adjacent to the mating contact elements 32 in the predetermined horizontal direction 22, respectively. When the driving plates 17 are moved along the top surfaces 21 of the insulator housings 16 in the predetermined horizontal direction 22, each of the conductive terminal members 13 is carried to the slidably inserted between the first and the second contact plates 51 and 52. As a result, the conductive terminal member 13 comes into contact with the mating contact element 32. Thus, the conductive terminal member 13 is electrically connected to the electric circuit board 12. A combination of the driving plates 17 will be collectively referred to herein as a driving element.

Figure 7:
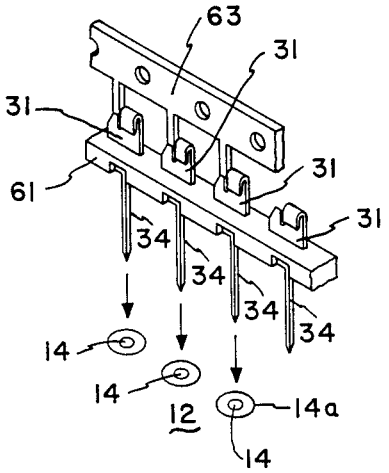
FIGS. 7 and 8 are perspective views for explaining assembling steps of the electrical connector in FIGS. 4 and 5.
Figure 8:
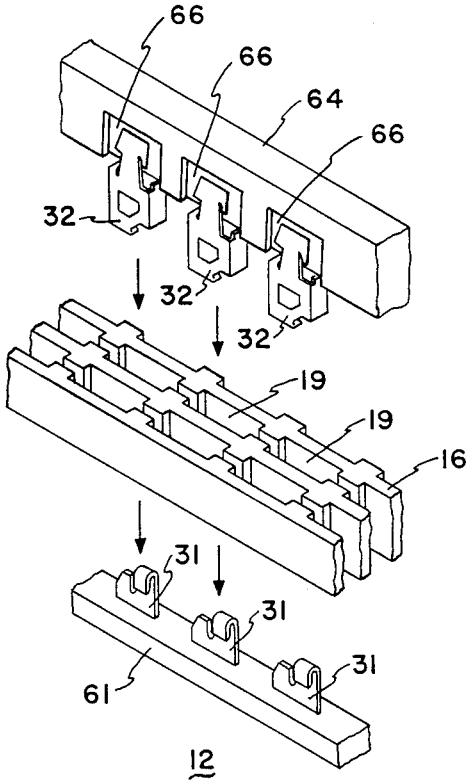

Referring to FIGS. 7 and 8, description will be made as to steps for mounting the electrical connector on the electric circuit board 12. In FIG. 7, predetermined ones of the terminal pin elements 31 are connected to a single carrier portion 63. The carrier portion 63 is used to continuously produce the respective terminal pin elements 31 from a conductive band plate by punching method. Therefore, the carrier portion 63 is cut off from the terminal pin elements 31 after the terminal pin elements 31 are mounted onto the electric circuit board 12.

Before, the carrier portion 63 is cut off from the terminal pin elements 31, the terminal pin elements 31 are supported by the contact holder 61 by, for example, plastic moulding the contact holder. As a result, the pin portion 34 are fixedly arranged in respective desired positions relative to one another.

In this state, the pin portion 34 are inserted into the through holes 14 of the electric circuit board 12, respectively. As a result, the contact holder 61 is seated on the electric circuit board 12. After the terminal pin portion 31 are mounted to the electric circuit board 12, the carrier portion 63 is cut off from the terminal pin elements 31.

Referring to FIG. 8, the insulator housing 16 is placed on the contact holder 61 so that the contact containing holes 19 receive the top connecting portions 33 of the terminal pin elements 31, respectively. In addition, a jig 64 is used for connecting the mating contact elements 32 to the terminal pin elements 31, respectively. The jig 64 is formed with a plurality of thin portions 66 which are spaced from one another along a bottom side edge thereof so as to correspond to the contact containing holes 19. The mating contact elements 32 are attached to the thin portions 66 of the jig 64, respectively, so that each of the thin portions 66 is fitted between the first and the second contact plates 51 and 52 (FIG. 6) of a corresponding one of the mating contact elements 32. The mating contact elments 32 are inserted into the contact containing holes 19, respectively. In this event, it is matter of course that each of the mating contact elements 32 is electrically connected to each of the terminal pin elements 31 within each of the contact containing holes 19.

Next, the jig 64 is moved upwardly. In response to the movement, the mating contact members 32 are mechanically connected to the terminal pin elements 31, respectively, and are slidingly removed from the jig 64. Thus, the mating contact members 32 are assembled into the insulator housing 16 together with the terminal pin elements 31.

While the present invention has been described in conjunction with a specific embodiment thereof, it will readily be possible for those skilled in the art to put this invention into practice in various other manners. For example, the mating contact element 32 may have a pin-type portion as the top contact portion 33. In addition, the contact member 30 may be modified so that the terminal pin element 31 has a plug-type portion as the top connecting portion 33 and that the mating contact element 32 has a socket-type portion as the lower mating portions 41 for receiving the plug-type portion.

What is claimed is:

1. In an electrical connector to be assembled on an electric circuit board for use in an electric connection of a conductive terminal member to an electrical conductive pattern formed on said electric circuit board with a through hole formed therein, said conductive terminal member being movable in a predetermined horizontal direction, said electrical connector comprising an insulator housing to be mounted on said electric circuit board and a contact member to be fixedly and electrically connect to said electrical conductive pattern and to be mated with said conductive terminal member, said insulator housing having a containing hole for receiving said conductive terminal member and for containing said contact member in the assembled condition, the improvement wherein said contact member comprises a terminal pin element and a mating contact member comprises a terminal pin element and a mating contact element which are different individual parts, said terminal pin element comprising a top connecting portion and a pin portion to be inserted in the through hole of said electric circuit board and soldered to make a connection with said electrical conductive pattern of said electric circuit board, said mating contact element comprising a top contact portion for mating with said conductive terminal member, guide means generally horizontally projecting from said top contact portion for guiding said conductive terminal member into said top contact portion on horizontal movement of said conductive terminal member, and a lower mating portion for mating with said top connecting portion of said terminal pin element, said top connecting portion of said terminal pin element and said mating contact element being disposed in said containing hole in the assembled condition.

2. An electrical connector as claimed in claim 1, wherein said lower mating portion comprises a first and a second leaf spring portion opposite to one another, said top connecting portion being slidably inserted between, and being in contact with, said first and said second leaf spring portions.

3. An electrical connector as claimed in claim 2, wherein said top connecting portion comprises a first plate portion coupled to said pin portion and brought in contact with said first leaf spring portion, a second plate portion opposite to said first plate portion with a predetermined space left therebetween, said second plate portion being brought in contact with said second leaf spring portion, and a curved portion connecting said first and said second plate portions.

4. An electrical connector as claimed in claim 1, said conductive terminal member having a first predetermined surface and a second predetermined surface opposed to said first predetermined surface, wherein said top contact portion comprises a first and a second contact plate opposite to one another, said first contact plate being brought in contact with the first predetermined surface of said conductive terminal member, said second contact plate being brought in contact with the second predetermined surface of said conductive terminal member.

5. An electrical connector as claimed in claim 1, further comprising a holder to be laid on said electric circuit board but under said insulator housing, said holder holding said pin portion.

6. An electrical connector as claimed in claim 1, further comprising a driving member mounted on the top surface of said insulator housing to be slidable along the top surface so as to move said conductive terminal member in said predetermined horizontal direction.

7. An electrical connector to be assembled on an electric circuit board for use in making an electrical connection of a plurality of conductive terminal members to an electrical conductive pattern formed on said electric circuit board with a plurality of through holes formed therein, said electrical connector comprising an insulator housing with a lower surface to be opposite to said electric circuit board and a plurality of contact members, said insulator housing having a top surface opposite to said lower surface and a plurality of containing holes for receiving said conductive terminal members and for containing said contact members in the assembled condition, said conductive terminal members being inserted into the containing holes of said insulator housing, respectively, wherein the improvement comprises a driving member mounted on the top surface of said insulator housing, each of said contact members comprising a terminal pin element and a mating contact element which are different individual parts, said terminal pin element comprising a top connecting portion and a pin portion to be inserted into a corresponding one of the through holes of said electric circuit board and soldered to make a connection with said electrical conductive pattern of said electric circuit board, said mating contact element comprising a top contact portion for mating with said conductive terminal member and a lower mating portion for mating with said top connecting portion of said terminal pin element, said top connecting portion of said terminal pin element and said mating contact element being disposed in the corresponding one of said contact element being disposed in the corresponding one of said containing holes in the assembled condition, said driving member being slidable along the top surface of said insulator housing in order to move said conductive terminal members along said insulator housing to make each of said conductive terminal members come into contact with said top contact portion of each of said mating contact element.

8. An electrical connector as claimed in claim 7, each of said conductive terminal members extending along a predetermined axis which is perpendicular to a top surface of said insulator housing, wherein said driving member has a plurality of terminal receiving holes through which said conductive terminal members are inserted into said containing holes, respectively.

9. An electrical connector as claimed in claim 8, wherein said driving member comprises a plurality of driving plates arranged in parallel with one another in a first predetermined direction which is perpendicular to said predetermined axis, each of said driving plates being slidable along the top surface of said insulator housing in a second predetermined direction which is perpendicular to said first predetermined direction.

* * * * *